US006628790B1

(12) United States Patent
Klein

(10) Patent No.: US 6,628,790 B1
(45) Date of Patent: Sep. 30, 2003

(54) APPARATUS FOR ON-EAR OPERATION AND OFF-EAR OPERATION WITH TWO SOUND REPRODUCTION TRANSDUCERS

(75) Inventor: Erich Klein, Himberg (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 551 days.

(21) Appl. No.: 09/649,671

(22) Filed: Aug. 28, 2000

(30) Foreign Application Priority Data

Aug. 31, 1999 (EP) ..... 99890277

(51) Int. Cl.[7] ..... H04R 1/02

(52) U.S. Cl. ..... 381/89; 381/182; 381/338; 181/184; 181/160

(58) Field of Search ..... 381/87, 89, 335, 381/337, 338, 150, 345, 349, 350, 351, 395, 182, 97; 181/160, 179, 182, 184, 198, 199

(56) References Cited

U.S. PATENT DOCUMENTS 4,875,546 A * 10/1989 Krnan ..... 181/160
5,073,945 A * 12/1991 Kageyama et al. ..... 381/89
5,537,479 A * 7/1996 Kreisel et al. ..... 381/89
5,561,717 A * 10/1996 Lamm ..... 381/89
5,790,679 A 8/1998 Hawker et al. ..... 381/163
6,160,897 A * 12/2000 Klein ..... 381/396

FOREIGN PATENT DOCUMENTS

WO 9838832 A1 9/1998
WO 9838834 A1 9/1998
WO WO 99/60795 * 11/1999

* cited by examiner

*Primary Examiner*—Xu Mei

(57) ABSTRACT

In an adapted to be used in an on-ear mode and in an off-ear mode a holder compartment (6)accommodates a first transducer (20)and a second transducer (25)and the holder compartment (6)is bounded by a bounding wall (7)formed with internal sound ports (10, 11)and at least one additional internal sound port (22), and an outer wall (3)formed with external sound ports (15, 16)is spaced at a distance from the bounding wall (7), and at least one additional external sound port (19)is provided between the bounding wall (7)and the outer wall (3), and the two transducers (20, 25)can be driven with useful signals of the same phase in the off-ear mode and with useful signals of opposite phase in the on-ear mode.

4 Claims, 1 Drawing Sheet

APPARATUS FOR ON-EAR OPERATION AND OFF-EAR OPERATION WITH TWO SOUND REPRODUCTION TRANSDUCERS

BACKGROUND OF THE INVENTION

The invention relates to an apparatus as defined in the opening part of claim 1.

Such an apparatus is commercially available under the type designations AEG9080 and AEG9082 and is consequently known. In addition, reference is made to the patent document WO 97/47117 A1 for such an apparatus. In the known apparatus, the holder compartment, referred to as the back chamber in the patent document WO 97/47117 A1, accommodates only one electroacoustic transducer for the generation of sound, as a result of which only a comparatively low maximum sound volume is attainable with the known apparatus, which is unfavorable particularly in the off-ear mode. Moreover, with respect to the known apparatus it is to be noted that the holder compartment is bounded by a rear bounding wall which is remote from the electroacoustic transducer and which has a plurality of rear apertures covered with an acoustic friction material. These means have been provided in order to obtain an optimum frequency response for the generated sound in the on-ear mode. However, these rear apertures in the rear bounding wall of the holder compartment also lead to an undesirable reduction of the attainable sound volume in the off-ear mode because the opposite-phase sound waves emitted via the rear apertures distinctly attenuate the emitted useful sound waves. Moreover, it is to be noted that in the known apparatus the frequency response for the emitted useful sound waves can be influenced only with the aid of the single electroacoustic transducer, which may impose restrictions as regards a desired frequency response.

SUMMARY OF THE INVENTION

It is an object of the invention to preclude the aforementioned problems and restrictions in a simple manner and to provide an improved apparatus for the emission of sound.

According to the invention, in order to achieve the aforementioned object with an apparatus as defined in the opening part of claim 1, the characteristic features defined in the characterizing part of claim 1 have been provided.

As a result of the provision of the characteristic features in accordance with the invention it is achieved in a comparatively simple and also comparatively cheap manner that as a result of the opposite-phase drive of the two transducers a satisfactory, i.e. as constant as possible, frequency response is obtained for the useful sound waves emitted into the ear. Moreover, the opposite-phase drive of the two transducers provides a high degree of privacy in the on-ear mode because owing to the opposite-phase drive of the two transducers the sound waves then generated, which are emitted into the acoustic free space via the intermediate space between the bounding wall and the outer wall and the at least one external additional sound port which issues from the intermediate space, propagate into the acoustic free space with only a comparatively low sound pressure, as a result of which these sound waves, after they have emerged into the acoustic free space, are rapidly attenuated to such an extent that, even at a comparatively short distance from the sound-emitting apparatus, the emitted sound, for example reproduced speech, is no longer intelligible to someone who happens to listen in. Moreover, in the apparatus in accordance with the invention it is achieved in a simple manner and without any further separate means that when the apparatus is held against the ear though the apparatus is in the off-ear mode no excessive sound pressure is produced in the user's ear and the possibility of a hearing defect is thereby precluded. Furthermore, it is thus achieved that, apart from the at least one internal sound port and the at least one additional internal sound port, the holder compartment can be constructed so as to be acoustically impervious, i.e. has no rear ports as in the case of the known apparatus described in the introduction, so that neither any problems caused by such rear ports cannot arise.

An apparatus in accordance with the invention may have internal sound ports in the form of bores which extend, for example, transversely to the bounding wall and whose ends which are remote from the second transducer terminate in the intermediate space. However, it has proved to be very advantageous when an apparatus in accordance with the invention in addition has the characteristic features defined in claim 2. Such a construction has the advantage of lower losses, as a result of which a higher volume of sound is attainable in the off-ear mode.

With an apparatus in accordance with the invention it has further proved to be very advantageous when, in addition, the characteristic features defined in claim 3 are provided. As a result of this construction, which enables the relative position of the at least one external sound port with respect to the two transducers to be chosen as required, the volume of sound produced in an ear in the on-ear mode can be adapted easily and simply to a desired situation.

In an apparatus in accordance with the invention it has further proved to be very advantageous when, in addition, the characteristic feature defined in claim 4 is provided. In this way it comparatively simple to realize a desired overall frequency response.

The afore-mentioned as well as further aspects of the invention will become apparent from the embodiment described hereinafter by way of example and will be elucidated with reference to this embodiment.

BRIEF DESCRIPTION OF THE DRAWING

The invention will now be described in more detail with reference to the drawing, which shows an embodiment given by way of example but to which the invention is not limited.

DESCRIPTION OF THE PREFERRED EMBODIMENTS

Figure 1:
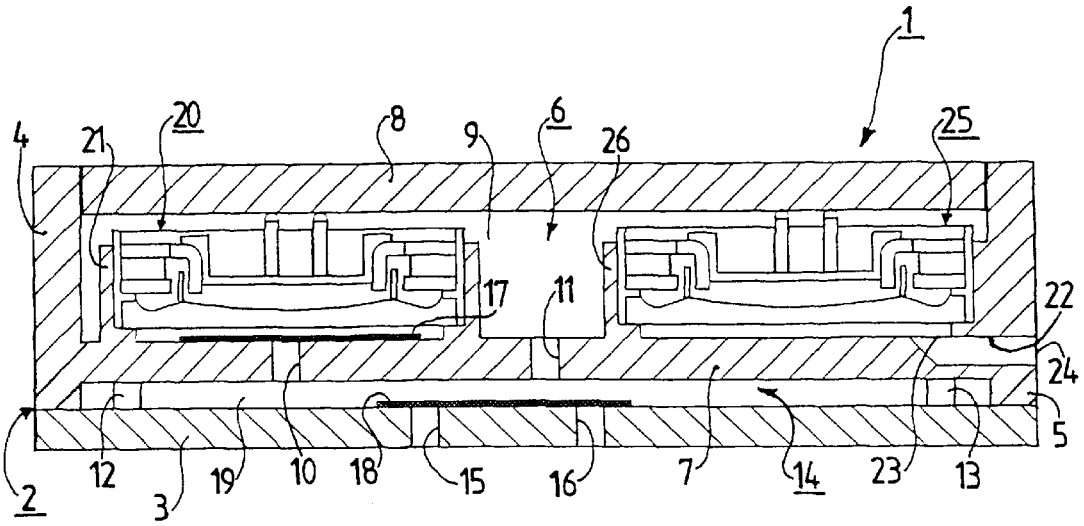
FIG. 1 is a partly diagrammatic sectional view of a part of an apparatus in accordance with an embodiment of the invention.

FIG. 1 shows a part of an apparatus 1 which takes the form of a mobile telephone. The apparatus is constructed to emit sound, i.e. to emit sound corresponding to speech signals received by the apparatus 1 and sound corresponding to a ringing signal that can be generated by the apparatus 1. The apparatus 1 is adapted to operate in an on-ear mode and in an off-ear mode. In the on-ear mode the user applies the apparatus 1 directly to an auricle of the user. In the off-ear mode the apparatus 1 is disposed comparatively far from the user's ears, in which mode the apparatus 1 is for example held in a holder for the apparatus 1 or lies on a desk top or on the top surface-of another piece of furniture. The on-ear mode is often also referred to as the hand-set mode. The off-ear mode is often also referred to as the hands-free mode.

The apparatus 1 has a housing 2 having housing walls, which housing 2 is shown only partly in FIG. 1. The housing has an outer front wall 3, a left-hand side wall 4 and a right-hand side wall 5.

The apparatus 1 further has a holder compartment 6 situated in the housing 2 and bounded by six bounding walls in total, of which only five bounding walls are visible in FIG. 1 as a result of the representation in sectional view. These five bounding walls include a front bounding wall 7, a rear bounding wall 8 and a lower bounding wall 9, as well as the left-hand side wall and the right-hand side wall 5 of the housing. In the present case the rear bounding wall 8 is formed by a printed circuit board which carries the electrical parts of the apparatus 1. The front bounding wall 7 has a plurality of sound ports, of which FIG. 1 shows only two such internal sound ports 10 and 11.

As is apparent from FIG. 1, the outer front wall 3 of the housing 2 is spaced at a distance from the front bounding wall 7 of the holder compartment 6. The distance between the two walls 3 and 7 is approximately 1.0 mm. The distance between the two walls 3 and 7 is defined by pin-shaped or rib-shaped spacers, two of said spacers 12 and 13 being shown in FIG. 1. The front bounding wall 7 and the outer front wall 3 together bound an intermediate space 14. The outer front wall 3 has a plurality of external sound ports, FIG. 1 showing two of said external sound ports 15 and 16. When a user uses the apparatus 1 in the on-ear mode the external sound ports 15 and 16 should face the inner part of the auricle of the user, as a result of which sound produced by the apparatus 1 in the on-ear mode reaches the ear of a user via the external sound ports 15 and 16.

In the area of the ends of some of the internal sound ports, which ends face the holder compartment 6 and which directly adjoin the internal sound port 10, a piece of fabric 17 attached to the front bounding wall 7 forms an acoustic friction material and thus serves as an acoustic friction. Likewise, a second piece of fabric 18 is attached to the outer front wall 3 in the area of the ends of the external sound ports 15 and 16, which ends face the intermediate space 14, and also forms an acoustic friction. The two pieces of fabric 17 and 18 have been provided in order to influence the frequency response.

Furthermore, between the front bounding wall 7 of the holder compartment 6 and the outer wall 3 of the housing 2 the apparatus 1 has an additional external sound port 19 formed by a slot which extends between the two side walls 4 and 5 of the housing 2. The external sound port 19 enables the sound waves to be emitted substantially parallel to the front bounding wall 7 and to the outer front wall 3.

The apparatus 1 further includes a first electroacoustic transducer 20 for the generation of sound. The first transducer 20 is accommodated in the holder compartment 6, for which purpose a first hollow cylindrical mounting ring 21 has been provided in the holder compartment 6, which ring projects from the front bounding wall 7 and holds the first transducer 20. The first transducer 20 can generate sound waves which can be emitted into the intermediate space 14 through the internal sound ports 10 and 11 and which can emerge from the intermediate space 14 through the external sound ports 15 and 16 and also through the one additional external sound port 19.

The apparatus 1 advantageously has an additional internal sound port 22 in the front bounding wall 7 of the holder compartment 6. In the present case the additional internal sound port 22 is a duct which extends in the front bounding wall 7 parallel to the front bounding wall 7, which duct has one end 23 which opens into the holder compartment 6 and another end 24 which opens into the acoustic free space. The holder compartment 6 of the apparatus 1 advantageously further accommodates a second electroacoustic transducer 25 for the generation of sound. For this purpose, a second hollow cylindrical mounting ring 26 has been provided in the holder compartment 6, which ring projects from the front bounding wall 7 and holds the second transducer 25. The second transducer 25 can generate sound waves which can be emitted into the intermediate space 14 through the internal sound port 11 and from the intermediate space 14 into the acoustic free space through the external sound ports 15 and 16. The second transducer 25 can further generate sound waves which can be emitted into the acoustic free space through the additional internal sound port 22.

The construction of the two transducers 20 and 25 is not described in greater detail herein. In this respect, reference is made to the two patent documents WO 98/38832 A1 and WO 98/38834 A1, which are incorporated herein by reference.

Figure 2:
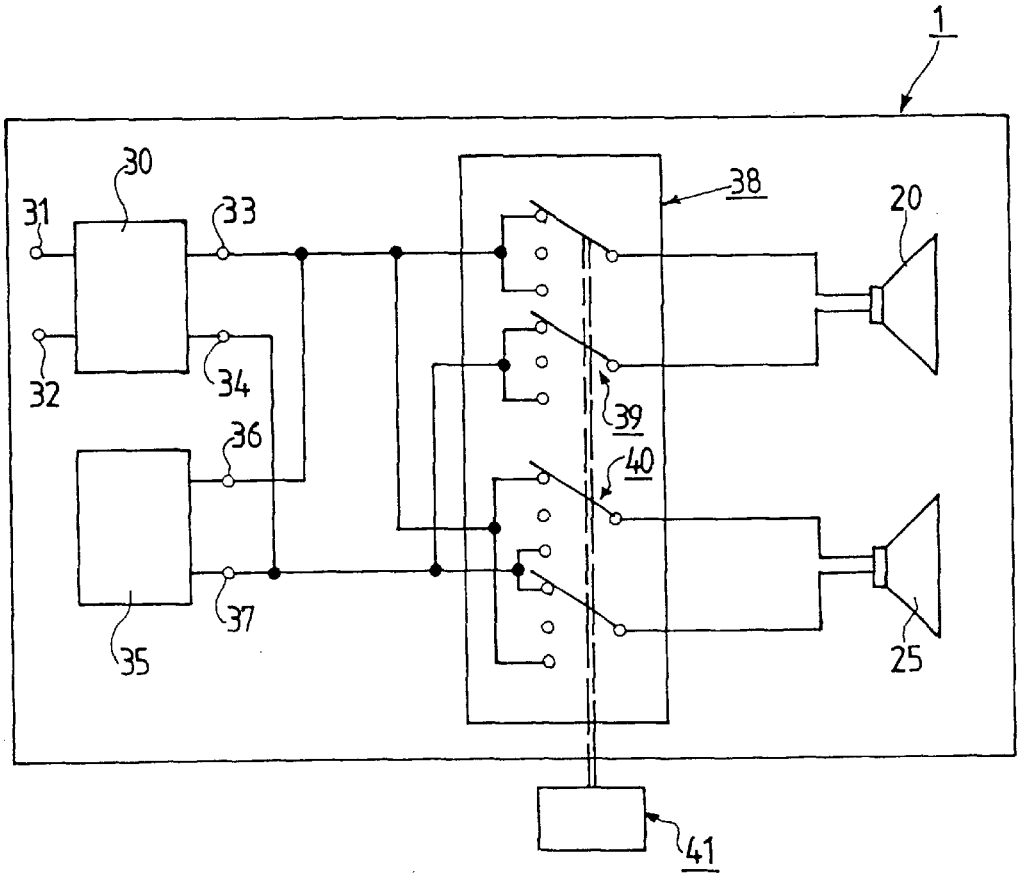
FIG. 2 is a block diagram which shows a part of the electrical circuit of the apparatus shown in FIG. 1.

FIG. 2 shows, in addition to the first transducer 20 and the second transducer 25 of the apparatus 1, some electrical parts of the apparatus 1 which are relevant in the present context and which will be described in more detail hereinafter. The apparatus 1 includes a first signal source 30 having two inputs 31 and 32 to which, in a manner not shown, speech signals received by the apparatus 1 can be applied, which signal source is adapted to process these speech signals and which is also adapted to supply the processed speech signals at two outputs 33 and 34. The apparatus 1 further includes a second signal source 35 by means of which a ringing signal can be generated and which is adapted to supply the generated ringing signal at two outputs 36 and 37. The two signal sources 30 and 35 are arranged, respectively, to supply the speech signal and the ringing signal to the two electroacoustic transducers 20 and 25.

The apparatus 1 further has application means 38 with the aid of which a useful signal to be supplied to the first transducer 20 can always be applied to the first transducer 20 in a first phase relationship and with the aid of which a useful signal to be supplied to the second transducer 25 can be applied to the second transducer 25 in a first phase relationship but also in a second phase relationship opposite to the first phase relationship. In the present case, the application means 38 comprise two two-pole switches 39 and 40 which can each be switched in opposite directions from a neutral center position into either of two switch positions and which, as shown in FIG. 2, have their inputs connected to the outputs 33 and 34 of the first signal source 30 and the output 36 and 37 of the second signal source and which have their outputs connected to the two transducers 20 and 25. The wiring of the first switch 39 has been selected in such a manner that in the two switch positions of this switch a useful signal is always transferred in its first phase relationship. The wiring of the second switch 40 has been selected in such a manner that in one switch position a useful signal in a first phase relationship and in the other switch position a useful signal is transferred in a second phase relationship opposite to the first phase relationship. In the neutral center position of the two switches 39 and 40 the connection between the two signal sources 30 and 35 and the two transducers 20 and 25 is interrupted. If such a possibility to interrupt the connection between the signal sources 30 and 35 and the two transducers 20 and 25 is not required, the first switch 39 may be dispensed with and may be replaced with two conductive connections.

The apparatus 1 further includes control means 41, which in the present case are formed by a diagrammatically shown switch which has three switch positions and, depending on its three switch positions, sets the two switches 39 and 40 to one of their switch positions or to their neutral positions. In the off-ear mode the control means 41 ensure that a useful signal is applied to the second transducer 25 in the first phase relationship, namely in that the control means 41 set the second switch 40 to its switch position shown in FIG. 2. In the on-ear mode the control means 41 ensure that the useful signal is applied to the second transducer 25 in the second phase relationship, namely in that the control means 41 set the second switch 40 to its second switch position which is not shown in FIG. 2.

As is apparent from FIG. 1, the external sound ports 15 and 16 in the apparatus 1 have been provided in the outer front wall 3 of the housing 2 in such a manner that, viewed in a direction which extend substantially perpendicularly to the outer front wall 3 and the front bounding wall 7 of the holder compartment 6, the external sound ports 15 and 16 are situated between the two transducers 20 and 25.

As regards the two transducers 20 and 25 it is to be noted that the two transducers 20 and 25 advantageously have different acoustic characteristics.

With apparatus 1 it is achieved in a simple and low-cost manner that in the on-ear mode, owing to the opposite-phase drive of the to transducers 20 and 25, a satisfactory frequency response, i.e. one which is subsequently constant within a useful frequency range between approximately 300 Hz and 3200 Hz, is obtained for the useful sound emitted into an ear. Moreover, the opposite-phase drive of the two transducers 20 and 21 provides a high degree of privacy of telephone conversations in the on-ear mode. Furthermore, the apparatus 1 provides a very high degree of protection for the ears of a user because it is ensured that the sound pressure of sound waves emitted via the external sound ports 15 and 16 is limited to a safe proportion. In addition, it is achieved with the apparatus 1 that the two transducers 20 and 25 can at the same time also be used for the reproduction of a ringing signal, the two transducers being driven with a ringing signal of the same phase, which consequently guarantees a high volume of sound. Furthermore, the apparatus 1 has the advantage that, apart from the internal sound ports 10 and 11 and the additional internal sound port 22, the holder compartment 6 can be of an acoustically impervious construction, which is advantageous in view of a maximal volume of sound.

The invention is not limited to the example of an embodiment described hereinbefore. For example, one or more additional internal sound ports may be provided, which are formed by bores which extend transversely to the front bounding wall 7. Instead of the application means 38 formed with the aid of switches 39 and 40 it is also possible to provide electronic application means. Instead of control means 41 in the form of a manually operable switch other control means may be provided, namely so-called proximity detectors, by means of which it can be detected whether an apparatus in accordance with the invention is disposed in the proximity of an ear or whether the apparatus is situated at a location remote from the head of a user.

What is claimed is:

1. An apparatus (1)

which is adapted to emit sound, and which is adapted to be used in an on-ear mode and in an off-ear mode, and which has a housing (2) having housing walls, and which includes a holder compartment (6) which is accommodated in the housing (2) and which is bounded by a bounding wall (7) formed with at least one internal sound port (10, 11), and which has an outer wall (3) which is spaced at a distance from the bounding wall (7) and which together with the bounding wall (7) bounds an intermediate space (14) and has at least one external sound port (15, 16) which during use of the apparatus (1) in the on-ear mode by a user is to be held so as to face the inner part of the auricle of the user, and which has at least one additional external sound port (19) between the bounding wall (7) and the outer wall (3), through which port the sound waves can emerge in directions substantially parallel to the bounding wall (7) and to the outer wall (3), and which includes an electroacoustic transducer (20) for the generation of sound, which transducer is accommodated in the holder compartment (6) and can generate sound waves which can be emitted through the at least one internal sound port (10, 11) into the intermediate space (14) and from the intermediate space (14) through the at least one external sound port (15, 16) and through the at least one additional external sound port (19), and which includes at least one signal source (30, 35) adapted to drive the electroacoustic transducer (20) with at least one useful signal, characterized in that the bounding wall (6) has at least one additional internal sound port (22), and the holder compartment (6) accommodates a second electroacoustic transducer (25) for the generation of sound, by means of which second electroacoustic transducer sound waves can be generated which can be emitted through the at least one additional internal sound port (22), and application means (38) have been provided with the aid of which a useful signal to be applied to the first transducer (20) can always be applied to the first transducer (20) in a first phase relationship and with the aid of which a useful signal to be applied to the second transducer (25) can also be applied to the second transducer (25) in a first phase relationship but, in additional, also in a second phase relationship opposite to the first phase relationship, and control means (41) have been provided which ensure that in the off-ear mode a useful signal is applied to the second transducer (25) in the first phase relationship and in the on-ear mode a useful signal is applied to the second transducer (25) in the second phase relationship.

2. An apparatus (1) as claimed in claim 1, characterized in that the additional internal sound port (22) is a duct in the bounding wall (7), which duct extends parallel to the bounding wall (7) and opens into the acoustic free space with its end (24) which is remote from the second transducer (25).

3. An apparatus (1) as claimed in claim 1, characterized in that, viewed in a direction which extends substantially perpendicularly to the outer wall (3) and the bounding wall (7), the at least one external sound port (15, 16) is situated between the two transducers (20, 25).

4. An apparatus (1) as claimed in claim 1, characterized in that the two transducers (20, 25) have different acoustic characteristics.

* * * * *